US005163522A

United States Patent [19]

Eaton et al.

[11] Patent Number: 5,163,522

[45] Date of Patent: Nov. 17, 1992

[54] ANGLED SIDEWALL CORING ASSEMBLY AND METHOD OF OPERATION

[75] Inventors: Nick G. Eaton, Kingwood, Tex.; Steven R. Radford, South Jordan, Utah

[73] Assignee: Baker Hughes Incorporated, Houston, Tex.

[21] Appl. No.: 703,024

[22] Filed: May 20, 1991

[51] Int. Cl.[5] ..... E21B 49/06

[52] U.S. Cl. ..... 175/58; 175/246; 166/117.6

[58] Field of Search ..... 175/58, 309, 246; 166/117.5, 117.6, 187

[56] References Cited

U.S. PATENT DOCUMENTS

| | | | |
|---|---|---|---|
| 2,494,932 | 1/1950 | Denning et al. . | |
| 2,558,227 | 6/1951 | Yancey et al. . | |
| 2,707,617 | 5/1955 | Brady . | |
| 4,397,355 | 8/1983 | McLamore | 166/297 |
| 4,665,995 | 5/1987 | Braithwaite et al. | 175/45 |
| 4,765,404 | 8/1988 | Bailey et al. | 166/117.6 |
| 4,955,438 | 9/1990 | Juergens et al. | 175/246 X |
| 5,009,273 | 4/1991 | Grabinski | 175/61 |
| 5,038,873 | 8/1991 | Jurgens | 175/246 |

*Primary Examiner*—Terry Lee Melius
*Attorney, Agent, or Firm*—Trask, Britt & Rossa

[57] ABSTRACT

The present invention is a sidewall coring assembly and method for taking a core sample at an angle to an existing borehole. The assembly includes a core barrel run at the end of a drill string and having a whipstock suspended below it, the whipstock having an anchor packer at its lower end. The packer is hydraulically inflated through the core barrel and an hydraulic line extending from the bottom thereof, the core barrel is released from the whipstock and the hydraulic line, and lowered to core at the angle and azimuth dictated by the whipstock. After coring is completed, the core barrel is withdrawn from the well and subsequently the whipstock and packer are retrieved with a stinger run on the drill string.

15 Claims, 2 Drawing Sheets

ANGLED SIDEWALL CORING ASSEMBLY AND METHOD OF OPERATION

BACKGROUND OF THE INVENTION

Field of the Invention

The present invention relates to the taking of core samples in subterranean formations, and specifically to the taking of core samples in a direction departing from the sidewall of a borehole.

State of the Art

For many years, geologists in the oil and gas exploration industry have taken and analyzed core samples of potential hydrocarbon-producing formations as part of their efforts to determine the profitability of completing wells from which the core samples are taken, as well as the desirability of further exploratory drilling in the same area. The problem with coring in exploratory wells is the lack of knowledge of the exact location of the formation of interest, or "pay zone," with respect to the well depth. In many instances, drillers have unintentionally drilled completely through the pay zone or target formation without taking any core samples because the pay zone was at a slightly lesser depth than anticipated. Since logging tools can be run into a borehole before it is cased and cemented to determine the location or locations of potential pay zones, coring of these promising zones subsequent to drilling and identification thereof via open-hole logging of the borehole provides a means to verify and enhance the information on production potential provided by seismic surveys and well logs. For obvious reasons, the only economic way to take core samples from a drilled borehole is from its sidewall.

Prior art sidewall coring tools have taken various forms. The most widely used of such tools shoot or punch sample cups into the sidewall of the borehole perpendicular to the borehole axis, and retrieve the cups when the tool is retrieved. Alternatively, tools have been employed which drill cores perpendicular to the borehole. Both types of tools are limited to extremely small diameter, very short cores which do not provide a substantial amount of formation to analyze, and which may therefore not be representative of the target formation characteristics. In addition, such prior art tools often cause damage to the formation by their operation.

Further prior art attempts at sidewall coring using a different approach employed a fixed whipstock within a coring tool run at the end of a drill string. A small core barrel was deployed within the tool adjacent to the whipstock and having a small Moineau-type mud motor and thrusting piston slip joint above the core barrel. At the desired location, an open hole packer on the coring assembly would be inflated by pumping mud down the drill string, the mud flow also powering the motor and thrusting the core barrel down the whipstock and out of the tool at a small angle into the formation. This coring tool also suffered the disadvantages of a small diameter, short (maximum 12") core, and the further limitation that the core sample was taken only at a very slight angle to the borehole, since the whipstock and coring assembly were both carried inside the tool.

Other coring devices which appear to provide the ability for taking core samples at greater angles to the borehole than the above-described internal whipstock tool are disclosed in U.S. Pat. Nos. 2,494,932; 2,558,227; and 2,707,617. These tools, however, employ a small diameter, short coring tool which is rotated via rotation of the drill string transmitted through clutch assemblies. The '617 patent also discloses a variation of the aforementioned punch type of core sampler.

U.S. Pat. No. 4,665,995 discloses an assembly for coring at the bottom of a borehole, a wedge or whipstock being deployed and oriented, and a pilot drilling assembly run down the whipstock at an angle to the borehole. To realm the angled pilot borehole to full diameter, the pilot drilling assembly is withdrawn from the well, and a full bore diameter core barrel is used to ream the pilot hole, following a retrievable pilot spear which is run into the pilot hole to guide the larger core barrel thereinto. In another embodiment, a wedge or whipstock is run into the borehole on a running assembly to a selected location, oriented, and an anchor associated with the whipstock is hydraulically set, after which the running assembly is withdrawn from the well. A full-diameter, standard core barrel is then run into the well and a branch borehole drilled in the direction dictated by the whipstock. The tools and method of the '995 patent, while obviously improvements over the other prior art described herein, suffer the disadvantages of requiring multiple runs or "trips" into and out of the well in order to perform a core sampling operation which results in a full-size core. Moreover, the apparatus of the '995 patent does not provide for retrievability of the whipstock assembly apart from the pilot drilling assembly, thus necessitating the subsequent use of a pilot spear to guide the full-size drilling assembly into the branching off of the main borehole.

SUMMARY OF THE INVENTION

The present invention provides a method and apparatus for obtaining a full-size core sample of substantially unlimited length at an angle to an existing borehole, with the ability to retrieve all of the components of the apparatus from the well.

The sidewall coring assembly of the present invention includes a whipstock suspended from a core barrel and having a means for anchoring the whipstock in the borehole, preferably an open hole packer, associated therewith. After the desired depth and azimuth for coring are reached, the packer is hydraulically expanded to secure the assembly in the borehole via pressure applied through the drill string, the interior of the core barrel and a conduit extending from the bottom of the core barrel to the packer, after which the hydraulic communication is severed and the core barrel is detached from the whipstock, rotated and driven downwardly against the inclined side of the whipstock and into the sidewall of the borehole. If a sample longer than the length of the core barrel inner tube is desired, the core barrel may be withdrawn from the well, a new inner tube installed therein, and run back again to exhaust the coring operation. After a core sample of desired length has been obtained, the whipstock and packer may be retrieved from the borehole by a stinger run on the drill pipe or tubing.

BRIEF DESCRIPTION OF THE DRAWINGS

.

DESCRIPTION OF THE PREFERRED EMBODIMENT

Figure 1A:
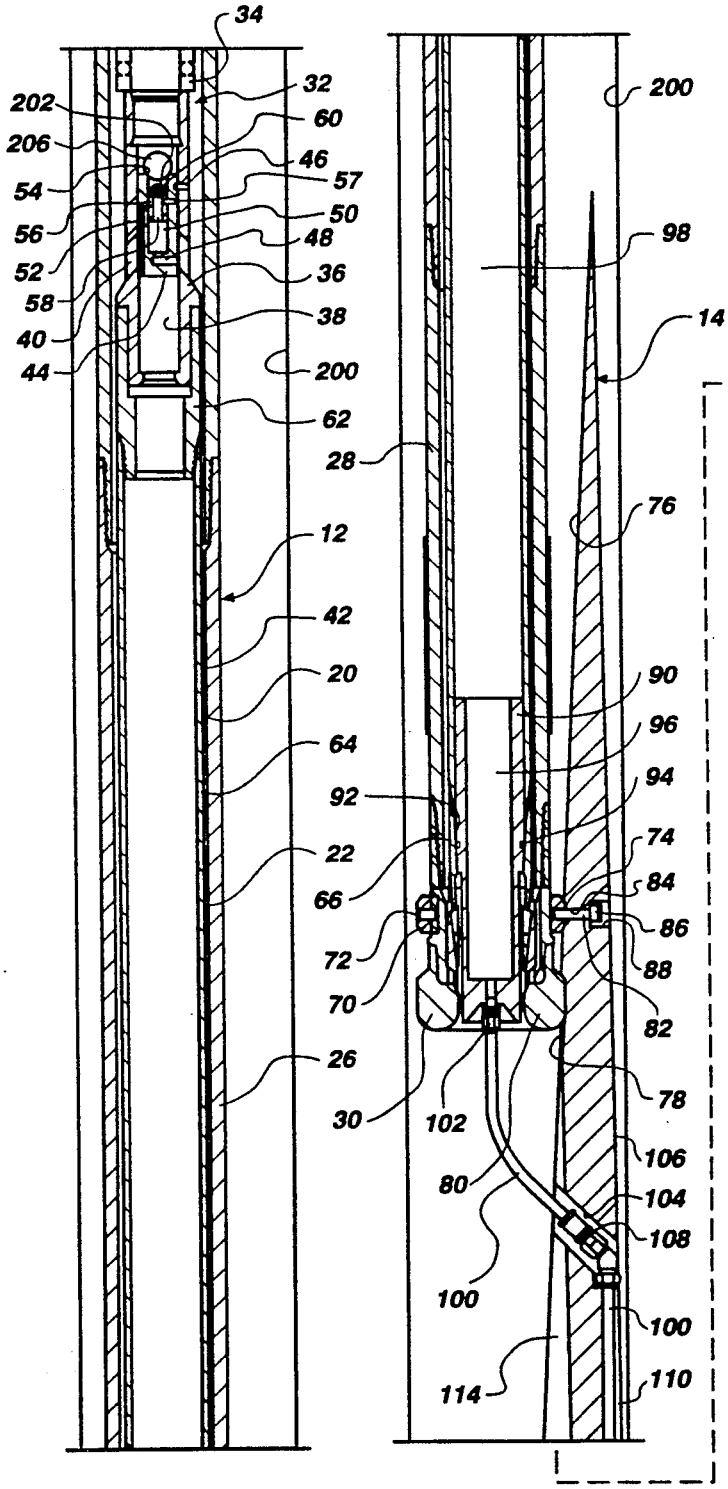
FIGS. 1A–1D comprise a sectional view of a coring apparatus of the present invention disposed in a borehole.
Figure 1B:
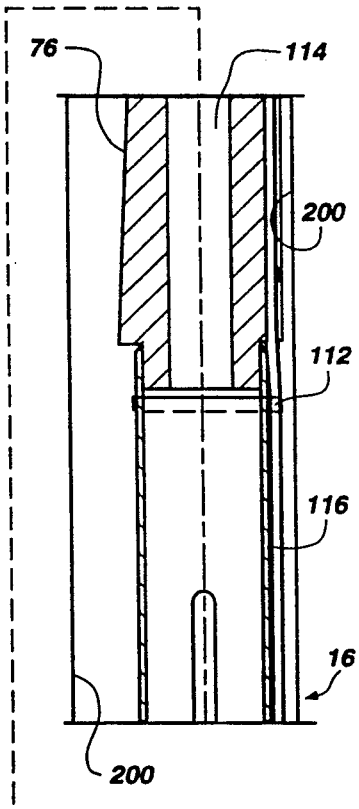
Figure 1C:
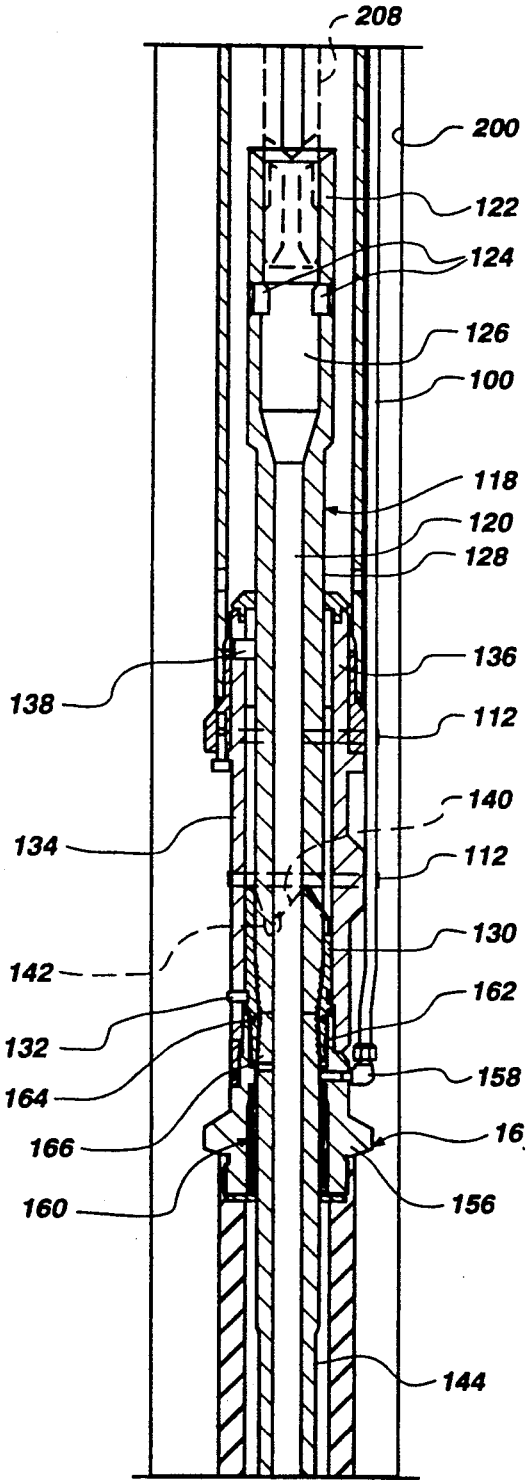
Figure 1D:
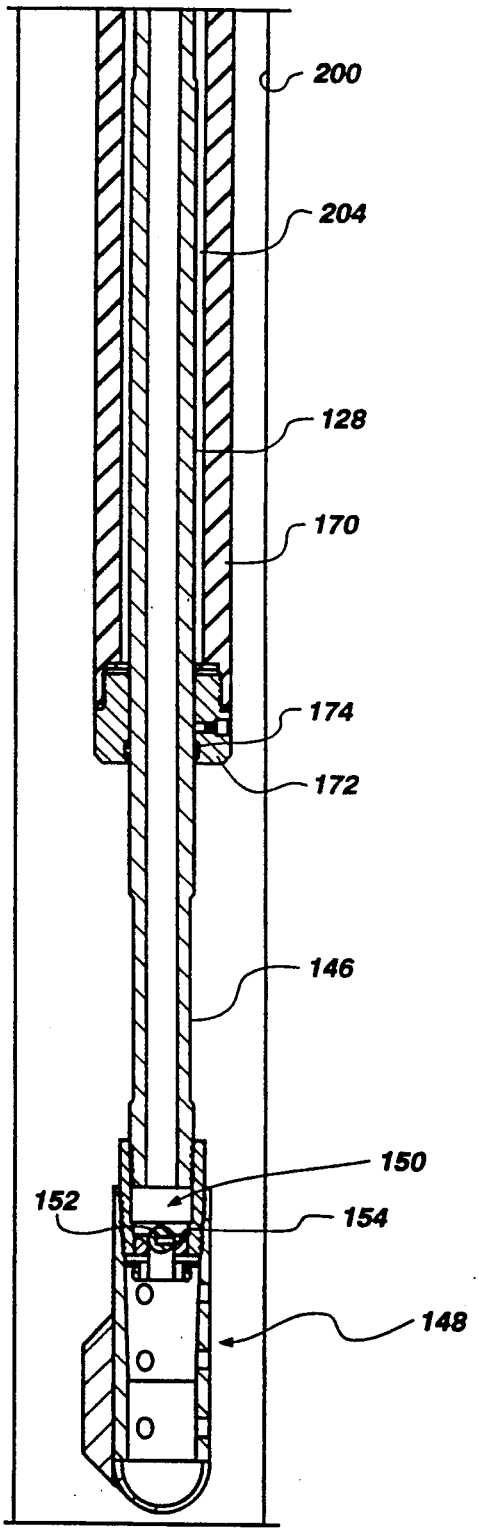

Referring to FIGS. 1A–1D of the drawings, sidewall coring assembly 10 of the present invention is depicted as disposed in a borehole 200 on the end of a drill string (not shown). The major components of sidewall coring assembly 10 include core barrel 12, whipstock 14 and open hole packer 16.

Core barrel 12 may be a modified conventional coring tool including an outer barrel assembly 20 and an inner tube assembly 22 rotatably suspended therein. Such devices are commercially available from Eastman Christensen Company of Houston, Tex., as the 250P or Coremaster TM core barrels. Outer barrel assembly 20 includes one or more tubular sections 26 above a tubular stabilizer section 28 to which the shank of core bit 30 is secured at its lower end. Inner tube assembly 22 includes a modified swivel assembly 32 employing thrust bearings 34 and an inner tube plug 36 rotatably disposed therebelow. Inner tube plug 36 has an axial bore 38 in communication with lateral passages 40 leading to an annulus 42 between outer barrel assembly 20 and inner tube assembly 22. Coring valve sleeve 44 is shear-pinned at 46 across passages 40, bypass channel 48 extending between one or more such passages 40 and the bottom of axial bore 50. Inflation channel 52 extends longitudinally in the wall of coring valve sleeve 44 to substantially the middle thereof, opening onto axial bore 50. Ball seat 54 surrounds the top of axial valve bore 50. Inflation valve sleeve 56 is shear-pinned at 57 to the inner wall of coring valve sleeve 44, covering the point of entry of inflation channel 52 onto bore 50 and itself defining an axial bore 58 topped by ball seat 60. Inner tube plug bushing 62 is secured to plug 36, and one or more sections of inner tube 64 are suspended therefrom, core catcher shoe assembly 66 being disposed at the bottom of inner tube assembly 22 adjacent core bit 30.

The lower end of core barrel 12 is modified from the prior art in several respects to permit suspension of whipstock 14 therefrom and to aid in the inflation of the open hole packer 16. Collar 70 is disposed about core bit 30 in sections and secured thereabout as by screws 72, rotation between collar 70 and core bit 30 being prevented by flats on the core bit exterior which cooperate with like-configured surfaces on the collar interior. The side 74 of collar 70 adjacent whipstock 14 is angled or wedge-shaped at the same angle to the longitudinal as the whipstock surface 76, in order to permit whipstock 14 to hang straight from or in parallel alignment with core barrel 12. A modification to whipstock 14 also in aid of this mutual orientation is a recess 78 in whipstock surface 76 to accommodate the outer gage or crown 80 of core bit 30, which also reduces the lateral dimension of the assembly 10 in the vicinity of the core barrel to whipstock connection. Collar 70 is secured to whipstock 14 by one or more shear bolts 82, which may be of brass, aluminum, steel or other material having a suitable shear strength or notched or treated to provide same. Shear bolts 82 extends through bore 84 into collar 70, the heads 86 of bolts 82 being accommodated in counterbore 88 in whipstock 14.

Modifications to the lower portion of inner tube assembly 22 include cylindrical rabbit 90 disposed within the lower end thereof adjacent core catcher shoe assembly 66, rabbit 90 being retained against downward removal from inner tube assembly 22 by shoulder 92, and sealed therewith by O-ring 94. It may also be desirable to fix rabbit 90 against upward movement, which can be effected by a shear screw or pin (not shown) or other means which will not obstruct the bore of the inner tube assembly during coring operations.

The bore 96 of rabbit 90 communicates with the bore 98 of inner tube assembly 22, and with reinforced rubber high pressure hose 100 via a pressure fitting 102 such as may be used to connect and disconnect air hoses from pneumatic tools. Hose 100 extends downwardly from core barrel 12 and into angled hose bore 104 of whipstock 14, extending to the backside 106 thereof, a preferentially weakened connection fitting at 108 being disposed within hose bore 104. Such weakening may be effected by notching the fitting or by providing a mechanical connection susceptible to opening upon the application of a predetermined tension thereto. Below fitting 108, high pressure hose or tubing 100 extends downwardly to packer 16, being secured in longitudinal recess 110 in the backside 106 of whipstock 14 and to packer 16 by straps 112.

Whipstock 14 further includes cylindrical axial bore 114, which opens upwardly onto whipstock surface 76, presenting an elliptical cross section from above. The bottom of whipstock 14 is secured to tubular upper housing 116 of packer 16, which is aligned with axial bore 114 of whipstock 14, packer mandrel 118 of packer 16 also being aligned therewith and being at lesser diameter than axial bore 114.

Packer 16 preferably comprises a substantially conventional prior art retrievable open hole packer, modified for inflation (as set forth below) through hose or tubing 100 instead of through the bore of packer mandrel 118.

Packer mandrel 118 defines an open axial bore 120 and includes a fishing head 122 at the top thereof which includes radially inwardly extending lugs 124 in the enlarged upper portion 126 of bore 120 within fishing head 122. Below fishing head 122, mandrel 118 necks down to a substantially constant diameter surface 128 until it reaches profile sleeve 130 disposed thereabout and attached thereto, profile sleeve 130 connecting the upper and lower segments of packer mandrel 118. Profile sleeve 130 is shear-pinned at 132 to lug housing 134 below and secured to upper packer housing 116, lug housing 136 including one or more lugs 138 which extend radially inwardly to a diameter less than that of profile sleeve 130 and only slightly greater than that of mandrel surface 128. The top of profile sleeve 130 comprises a retrieval profile including a series of oblique edges 140 extending to lug recesses 142.

Below profile sleeve 130, mandrel 118 again returns to surface 128, excepting reduced diameter bleed surfaces 144 and 146. The bottom of mandrel 118 has junk basket 148 extending therefrom, including check valve 150 including ball 152 and seat 154.

Fixed packer shoe 156 is secured to the bottom of lug housing 136, and has been modified from its prior art structure to accommodate inlet fitting 158 to which hose or tube 100 extends, inlet fitting 158 being located above a schematically shown spring-loaded chevron-type (by way of example and not limitation) check valve 160. It should be noted that the upper interior end of shoe 156 is secured to the exterior of slot profile sleeve 130 via backoff threads 162, O-ring seals 164 and 166 being located, respectively, between shoe 156 and sleeve 130 and between sleeve 130 and the exterior of packer mandrel 118.

Elastomeric packer element 170 is secured to shoe 156 and extends downwardly therefrom, enveloping packer mandrel 118 until reaching sliding shoe 172, to which it is also secured, seal 174 providing a sliding seal between mandrel 118 and sliding shoe 172.

Referring to the drawings, the method of coring with sidewall coring assembly will be explained in detail. Prior to coring, borehole 200 is logged by open-hole logging techniques known in the art to identify the formation or formations by depth having the greatest seeming production potential. If the logging has been performed by wireline rather than during the drilling operation via a formation evaluation type measuring while drilling (MWD) tool, the logging tool is withdrawn from borehole 200 and sidewall coring assembly disposed therein on the end of a drill string as known in the art to a depth slightly above an identified target formation. A particular direction or azimuthal orientation of the whipstock may also be specified and achieved, if desired, by techniques well known in the art.

Upon reaching the proper depth and location, packer 16 is set by dropping setting ball 202 down the drill string, until flow of the pumped drilling mud causes it to seat on inflation valve ball seat 60. The pumping rate is then increased. As the usual flow which has previously been circulated to annulus 42 via bore 58, channel 48 and passage 40, is substantially blocked, the positive pressure differential above seated setting ball 202 causes inflation valve sleeve 56 to sever shear pin 57 and move downwardly in bore 50 of coring valve sleeve 44. This movement opens previously blocked inflation channel 52 and diverts mud pressure into bore 98 of inner tube assembly 22, through rabbit 90, into hose 100 and down to fixed packer shoe 156, past check valve 160 into annulus 204 between packer mandrel 118 and packer element 170, causing the inflation and radial expansion thereof against the sidewall of borehole 200 as sliding shoe 172 moves upwardly on mandrel 118. Check valve 160 prevents deflation of packer element 170 when mud pumping is stopped or the rate thereof reduced.

After packer element 170 is inflated, which may be determined by an increase in pumping pressure measured at the drill rig on the surface, coring ball 206 is dropped and pumped down to ball seat 54. Continued pumping results in the shearing of shear pin 46 and the downward movement of coring valve sleeve 44 in bore 38 of inner tube plug 36. To permit and augment the downward sleeve movement, it should be noted that setting ball 202 has several intersecting diametrical bores therethrough which, while insufficient to prevent the pressure differential required for movement of inflation valve sleeve 56, permit diversion of any trapped pressure from inner tube assembly bore 98 below setting ball 202 into bore 50, down bore 58 and out channel 48 to prevent such pressure from resisting downward movement of coring valve sleeve 44 in bore 38. The resultant opening of lateral passages 40 resulting from downward displacement of coring valve sleeve 44 readies core barrel 12 for the coring operation, saving only release from whipstock 14.

To release core barrel 12 from whipstock 14, the drill string is pulled upward or rotated with sufficient force to shear bolt or bolts 82, and pulled upward to break the preferentially weakened connection at fitting 108. The drill string is then rotated to commence taking of the core sample, and weight is applied to the drill string, causing the crown 80 of core bit 30 to ride out of recess 78 in whipstock surface 76, and along surface 76 to engage the sidewall of borehole 200. As the drill string is rotated and lowered and the formation core is cut, rabbit 90 is pushed upwardly in inner tube assembly 22 by the formation core, drawing the portion of hose 100 above fitting 108 thereinto behind it.

It is contemplated that rabbit 90 may include a hose retraction device to retract the segment of hose 100 above fitting 108 into inner tube assembly 22 to reduce the potential for interference between hose 100 and the core sample as it enters core barrel 12. However, this is not a required element of the invention. Alternatively, the preferentially weakened connection could be placed at fitting 102, and the segment of hose 100 therebelow retracted into a recess in the backside of whipstock 14.

The core continues to push the rabbit 90 and hose 100 ahead of it toward the top of the inner tube as coring progresses. When the full core has been cut, the core barrel 12 is withdrawn from the angled sidewall hole drilled off from borehole 200, withdrawal breaking off the core adjacent to core catcher shoe assembly 66. Core barrel 12 is then withdrawn to the surface where the sections 64 of the inner tube containing the core are removed. If desired, a new inner tube may be disposed in the core barrel 12, and the coring operation continued by rerunning the core barrel 12 in the well.

Once the coring operation at a particular depth and azimuth has been completed, whipstock 14 and packer 16 may be retrieved from the borehole 200. To effect retrieval, a stinger 208 (shown in broken lines having a j-slot therein) such as is well known in the art is run into borehole 200, through whipstock bore 114 and into fishing head 122 of packer mandrel 118. When downward motion of the stinger 208 is halted by contact with the lower end of the bore 126 of fishing head 122, a slight upward movement and/or rotation (depending upon the structure of the stinger and configuration of the j-slot) will lock stinger 208 to mandrel 118 via lugs 124 which are constrained in upwardly facing recesses on the exterior of stinger 208. Right hand rotation of the drill string, and thus of the stinger 208 and fishing head 122, results in the shearing of pin 132, in the backing off of backoff threads 162 and in the release of profile sleeve 130 and thus packer mandrel 128 from shoe 156. Upward movement of packer mandrel 118 then places reduced diameter bleed surfaces 144 and 146 adjacent the seals at check valve 160 and sliding shoe 172, which is now fixed in place due to inflation of packer element 170. The gaps created by the bleed surfaces provide channels for the relief of pressure within packer element 170, causing deflation thereof and release from the wall of borehole 200.

Further upward movement of stinger 208 causes retrieval profile surfaces 140 leading to recesses 142 of profile sleeve 130 to engage lugs 138 and thus lug housing 136, upper packer housing 116 and whipstock 14 being carried upward and out of the well. Thereafter, core barrel 12 may be resecured to whipstock 14, hoses reconnected between core barrel 12 and packer 16, shear pins reinserted in the assembly, and the assembly rerun to core at a new location.

Thus, it is apparent that a novel and unobvious sidewall coring assembly has been disclosed. Many additions, deletions and modifications to the preferred embodiment of the invention as disclosed herein are possible without departing from the spirit and scope of the claimed invention.

What is claimed:

1. An apparatus for sidewall coring of an uncased borehole, comprising:

a tubular core barrel;

a whipstock including a sloped whipstock surface and detachably secured to said core barrel proximate the lower end thereof;

a retrievable open-hole packer secured to the bottom of said whipstock; and a fluid passage extending from the interior of said core barrel to said packer for the setting thereof in said borehole.

2. The apparatus of claim 1, wherein said core barrel is secured to said whipstock on said whipstock surface with a wedge means therebetween.

3. The apparatus of claim 1, wherein said core barrel includes a core bit at the lower end thereof, said core bit includes a crown of greater diameter than said core barrel, and said sloped whipstock surface includes a recess therein for accommodating at least a part of said crown on the side of said core barrel adjacent said surface when said core barrel is secured to said whipstock.

4. The apparatus of claim 1, wherein said core barrel includes an outer barrel assembly and an inner tube assembly, and is secured to said whipstock via said outer barrel assembly.

5. The apparatus of claim 4, wherein said inner tube assembly includes a rabbit sealingly disposed therein proximate the bottom thereof, and said fluid passage extends from the interior of said inner tube assembly through said rabbit to said packer.

6. The apparatus of claim 4, wherein said inner tube assembly includes an inner tube having an inflation valve means and a coring valve means proximate the top thereof.

7. The apparatus of claim 6, wherein said inflation valve means is contained by said coring valve means.

8. The apparatus of claim 7, wherein said inner tube assembly includes a tubular inner tube plug having lateral passage means through the wall thereof for communicating said plug bore with an annulus defined between said inner tube assembly and said outer barrel assembly, said coring valve means is releaseably disposed in said bore across said lateral passage means, and said coring valve means includes a bypass channel therein communicating said lateral passage means with the bore of said core barrel above said plug when said coring valve means is disposed across said lateral passage means.

9. The apparatus of claim 8, wherein said coring valve means further includes an inflation channel communicating the interior of said inner tube with the bore of said core barrel above said plug, and said inflation valve means is releasably secured to said coring valve means across said inflation channel.

10. The apparatus of claim 9, wherein said coring valve means comprises a valve sleeve and defining a bore, and said inflation valve means comprises a valve sleeve disposed in said coring valve bore.

11. The apparatus of claim 10, wherein said coring valve sleeve and said inflation valve sleeve each include a ball seat at the top thereof, and each further includes balls sized to seat in said respective ball seats.

12. The apparatus of claim 1, wherein said fluid passage is breakable.

13. The apparatus of claim 11, wherein said fluid passage is breakable proximate said whipstock.

14. A method of sidewall coring an uncased borehole, comprising:

running into said borehole a whipstock having a retrievable open hole packer secured to the lower end thereof and a core barrel detachably secured to the upper end thereof;

positioning said whipstock in said borehole;

inflating said open hole packer through said core barrel and a fluid passage extending from the bottom thereof to said packer;

detaching said core barrel from said whipstock;

rotating and lowering said core barrel against said whipstock to guide said core barrel into the sidewall of said borehole; and cutting a core with said guided core barrel at an angle to said borehole.

15. The method of claim 13, further comprising withdrawing said core barrel containing said cut core from said borehole, and retrieving said whipstock and said packer from said borehole.

* * * * *